US008164445B2

(12) United States Patent
Kagermeier et al.

(10) Patent No.: US 8,164,445 B2
(45) Date of Patent: Apr. 24, 2012

(54) CABLELESS OPERATION OF A MEDICAL DEVICE

(75) Inventors: Robert Kagermeier, Nürnberg (DE); Dietmar Sierk, Erlangen (DE); Daniel Wunderlich, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 359 days.

(21) Appl. No.: 12/105,796

(22) Filed: Apr. 18, 2008

(65) Prior Publication Data

US 2008/0266085 A1 Oct. 30, 2008

(30) Foreign Application Priority Data

Apr. 25, 2007 (DE) ..... 10 2007 019 529

(51) Int. Cl.
*G08B 21/00* (2006.01)

(52) U.S. Cl. ..... 340/540; 340/825.72; 340/539.21

(58) Field of Classification Search ..... 340/540, 340/539, 568, 573, 539.1, 539.11, 539.12, 340/539.21, 545.3, 545.4, 551, 556–557, 340/568.1, 568.2, 578, 825.72
See application file for complete search history.

(56) References Cited

U.S. PATENT DOCUMENTS

| | | | | |
|---|---|---|---|---|
| 4,925,260 | A * | 5/1990 | Fisher et al. | 359/10 |
| 5,552,773 | A * | 9/1996 | Kuhnert | 340/573.1 |
| 5,557,094 | A * | 9/1996 | Barkan | 235/462.29 |
| 5,684,893 | A * | 11/1997 | Shikakura | 382/232 |
| 6,243,591 | B1 * | 6/2001 | Takemura | 455/522 |
| 7,581,031 | B2 * | 8/2009 | Konz et al. | 709/250 |
| 2004/0052295 | A1 * | 3/2004 | Draxton et al. | 374/117 |
| 2007/0025353 | A1 * | 2/2007 | Nambisan et al. | 370/392 |
| 2007/0270128 | A1 * | 11/2007 | Kakiuchi | 455/411 |
| 2008/0214111 | A1 * | 9/2008 | Moshir et al. | 455/41.2 |

* cited by examiner

*Primary Examiner* — Daniel Previl
(74) *Attorney, Agent, or Firm* — Lempia Summerfield Katz LLC

(57) ABSTRACT

A method for cableless transmission of operating signals from a mobile remote control unit to a medical device is provided. The method includes recording a transmission quality measurement, and blocking the transmission of the operating signals if the transmission quality measurement or a distance measurement between the remote control unit and a receiver unit of the device fulfills a predetermined trigger criteria. A step detection process is carried out by the remote control unit, and a change in the transmission quality measurement is taken into account if a step movement is determined in the step detection process.

22 Claims, 4 Drawing Sheets

CABLELESS OPERATION OF A MEDICAL DEVICE

This application claims the benefit of DE 10 2007 019 529.1 filed Apr. 25, 2007, which is hereby incorporated by reference.

BACKGROUND

The present embodiments relate to cableless operation of a medical device.

Medical diagnostic or treatment systems include one or more medical devices for treating a patient. A medical device is operable via one or more control units. A medical device may be, for example, an x-ray recording device, a computer or magnetic resonance tomograph, or an irradiation system.

Operators may operate the medical device from different spatial positions. Medical devices generally communicate with a remote control unit that transmits operating signals to the medical device. The operating signals are, for example, commands for moving equipment, such as adjusting a patient support, or for triggering radiation in the course of an image-recording or irradiation session.

A cableless operating system, such as one based on radio transmission, may be easier to manage and safer than a hard-wired operating system.

In a radio-based operating system, the remote control unit may be intentionally or unintentionally removed from the area surrounding the medical device, such as an examination room. Despite low transmission power, the radio link may still exist outside the room and that a critical system function (e.g. a device movement or a triggering of radiation) will be triggered by accidental actuation of an operating key.

Remote control units with safety-relevant operating functions are generally hard-wired because of the safety concerns, despite the comparatively low ease of operation and the inconvenience caused by the cable.

Because of the safety concerns, cableless remote controls are based on infrared transmission of the operating signals. Infrared transmission requires a visual link for transmitting the operating signals. Accordingly, the possibility of unintentional operating error through walls and closed doors is eliminated. However, only a limited signal transmission range can be achieved with infrared transmission. Moreover, the infrared transmission of operating signals may be obstructed by obstacles in the beam path between the remote control unit and the device.

SUMMARY AND DESCRIPTION

The present embodiments may obviate one or more of the problems or drawbacks inherent in the related art. For example, one embodiment may provide safe and reliable cableless operation of a device, such as a medical device.

As will be discussed below, a "step" refers to the lifting and the putting down of a foot.

In one embodiment, a method for transmission of operating signals from a mobile remote control unit to a device is provided. The method may include recording a transmission quality measure and blocking the transmission of operating signals if the transmission quality measure and/or a measure derived herefrom for the distance between the remote control unit and the receiver unit of the device fulfill a predetermined trigger criteria. Exceeding or falling below a predetermined threshold value of the transmission quality measure or distance measure is provided as a trigger criterion. A change in the transmission quality measure is taken into account when checking the trigger criteria and/or determining the distance measure if a step movement is identified.

The distance of the remote control unit from the receiver unit, and consequently from the device, may be used as a decision-making variable. The decision-making variable may be used to determine whether safe transmission of operating signals is possible. The distance may be estimated from the transmission quality of the operating signals, since transmission quality declines as distance increases. Transmission quality depends on other factors apart from the simple distance, for example, on scattering and reflecting of the signal-transmitting field or on field-attenuating obstacles. The distance of the remote control unit from the device may be determined via the displacement of the remote control unit in space. The movement may be determined by step detection, since a remote control unit is normally displaced by a user. Accordingly, the remote control unit undergoes the step movement of the operating person. Reliable distance information may be drawn from a correlation of the transmission quality with the step detection. In the correlation, only a radial step movement that is linked to a change in the transmission quality is namely taken into account, while an equidistant step movement is ignored. Through correlation of the transmission quality with the step detection, a displacement-determined change in the transmission quality can be distinguished from an impairment of the transmission quality by persons, objects and other obstacles in the room. By correlating the connection quality with the step detection, distance information may be obtained. The distance information may be used to determine whether or not it is safe to transmit operating signals.

Correlation may include correlating of the transmission quality measure and the step detection that results in only such changes in the transmission quality having an impact on the enabling or blocking of operating signal transmission as occur at the same time as a detected step movement.

The received field strength and/or the bit error rate of the transmitted operating signals may be used as a transmission quality measurement. The blocking of operating signal transmission may be carried out at the remote control unit end so that when transmission is blocked, the triggering of an operating signal and/or its cableless transmission to the device is prevented. Alternatively, the blocking may be carried out at the device end so that, while in this case an operating signal is transmitted to the device, the execution of an assigned action is refused. Either the distance itself or any variable, in particular a proportional variable, correlated herewith may be used as a distance measure.

In one embodiment, for step detection, the acceleration acting upon the remote control unit is recorded and evaluated. The evaluation is based on the recognition that a step movement is associated with a characteristic periodic change in (vertical) acceleration. A step movement may be detected by recording at least one high point and one low point of the recorded acceleration. To differentiate a step movement from other accelerations acting upon the remote control, for example, vibrations, an additional check is made as to whether the acceleration changes sufficiently before the high point or low point is reached. A step movement is detected when the change in the acceleration exceeds a predetermined threshold value before the high point or the low point is reached. One or more variables, which are characteristic for the step duration and/or the step frequency, may be additionally determined by analyzing the recorded acceleration. Step duration refers to the time span between the lifting and the putting down of the foot during a step. The step duration corresponds to the time span between a high point and a low point of the recorded acceleration. Step frequency refers to the number of steps detected per unit of time. Its reciprocal value (hereinafter also referred to as the step sequence duration) is used as a particularly precise measurement of step frequency. The step sequence duration is the time span between two consecutive high points or low points of the recorded acceleration.

Using the variable or variables described above, a plausibility value is determined that represents a measure of the error probability of the detected step movement. Determination of the plausibility value is influenced by stored empirical values relating to the expected step duration and/or step frequency and the number of steps detected in succession. An error in step detection is more improbable the closer the detected values for step duration and step frequency match the stored empirical values and the more individual steps in direct succession have been detected.

The method may be executed only when the remote control is located at a defined distance from the device and/or when the transmission quality measure has already fallen below a predetermined threshold value. As long as the remote control unit is located within close range of the device, in which the transmission quality measure exceeds the threshold value, the transmission of operating signals is enabled irrespective of changes in the transmission quality measure and irrespective of step detection.

Complete blocking of operating signal transmission is preferably preceded by a critical distance range in which the triggering of an operating signal is permitted only if an enabling signal is triggered in combination, for example, simultaneously or within a predetermined time period. The enabling mode is activated if the transmission quality measurement and/or the distance measurement are in a critical range with respect to predetermined threshold values.

In one embodiment, an optical or acoustic alarm signal may be emitted if an attempt is made to trigger an operating signal even though the transmission of operating signals is completely blocked or is permitted only in enabled mode.

In one embodiment, an apparatus (system) for cableless operation of a device includes a mobile remote control unit for the cableless transmission of operating signals to the device. The apparatus includes a receiver unit assigned to the device for receiving the operating signals and a control unit, which is optionally assigned to the remote control unit or to the device. The control module interacts with the remote control unit. The control module records the above-described transmission quality measurement and optionally determines based on the measurement the distance measurement and initiates (instigates) blocking of the transmission of operating signals if the transmission quality measurement and/or the distance measurement fulfill the trigger criteria. The remote control unit includes a step detection unit for the detection of steps according to the method. The control module correlates the transmission quality measurement and a step movement detected by the step detection unit.

In one embodiment, the step detection unit includes an acceleration sensor for recording the acceleration acting upon the remote control unit and an evaluation module that detects, in accordance with the method described above, a step movement by evaluating the recorded acceleration.

The control module and the evaluation module may be software modules, which are implemented so as to able to run in corresponding hardware modules of the remote control unit and/or of the device.

BRIEF DESCRIPTION OF THE DRAWINGS

Exemplary embodiments will be explained in detail below with the aid of drawings, in which.

DETAILED DESCRIPTION

Figure 1:
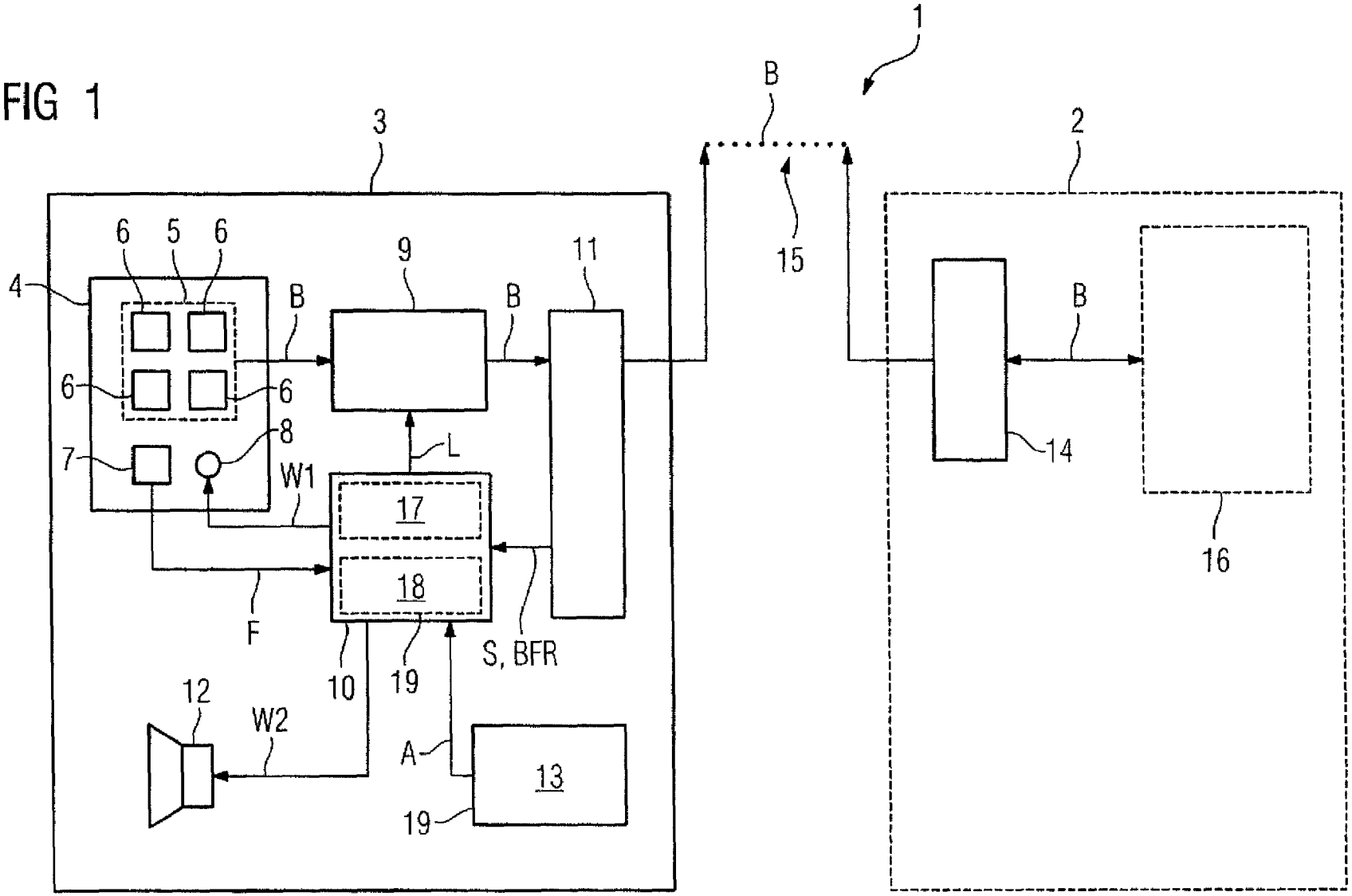
FIG. 1 shows in a schematically simplified block diagram of an apparatus for the cableless operation of a medical device with a remote control unit.

FIG. 1 shows an apparatus (system) 1 for the cableless operation of a medical device 2. The device 2 is, for example, a computer tomograph.

The apparatus 1 includes a mobile remote control unit 3. The remote control unit 3 includes an externally accessible operator panel 4. The operator panel 4 includes a keypad 5 having a number of operator keys 6, which may emit operating signals 3 for controlling the device 2. The operator panel 4 includes an enabling key 7, which may generate an enabling signal F, and a light-emitting diode (LED) 8.

The remote control unit 3 may include a keyboard control 9, a remote control 10, a radio unit 11, a loudspeaker 12 and a three-dimensional acceleration sensor 13.

At the medical device 2 end, the apparatus 1 includes a radio unit 14.

The keyboard control 9 serves to digitalize the operating signals B generated by the operator keys 6. In normal operating mode of the remote control unit 3, the keyboard control 9 routes the digitalized operating signals B to the radio unit 11. The radio unit 11 transmits the operating signals B over a radio path 15 (e.g., cablelessly) to the radio unit 14 acting as the receiver unit of the device 2.

The radio unit 14 forwards (transmits) the operating signals B to a device control 16 of the device 2. The device control 16 executes the operating signals B, for example, triggers a device movement or a radiation emission.

The remote control 10, which may be a microcontroller with assigned storage, monitors whether the transmission quality of the signal transmission between the radio unit 11 and the radio unit 14 is sufficient for safe signal transmission. As a measure of the transmission quality, the signal strength S and the bit error rate (BFR) are fed to the remote control 10 as an input signal by the radio unit 11.

For outputting a blocking signal L, the remote control 10 may be connected to the keyboard control 9 so as to block the keyboard control 9 if, pursuant to checking, safe signal transmission is not guaranteed. If there is a blocking signal L, the keyboard control 9 does not forward triggered operating signals B to the radio unit 11, so that no transmission of these operating signals B to the device 2 takes place.

The enabling signal F may be transmitted (fed) to the remote control 10 as input signals. The enabling signal F may be generated by the enabling key 7 and an acceleration signal A measured by the acceleration sensor 13. The remote control 10 may control the light-emitting diode 8 and the loudspeaker 12 for outputting optical alarm signals W1 or acoustic alarm signals W2.

A control module 17 and a step-detection module (evaluation module) 18 are implemented in the remote control 10 in the form of software modules. With the acceleration sensor 13, the step-detection module 18 may be used as a step-detection unit 19.

Figure 2:
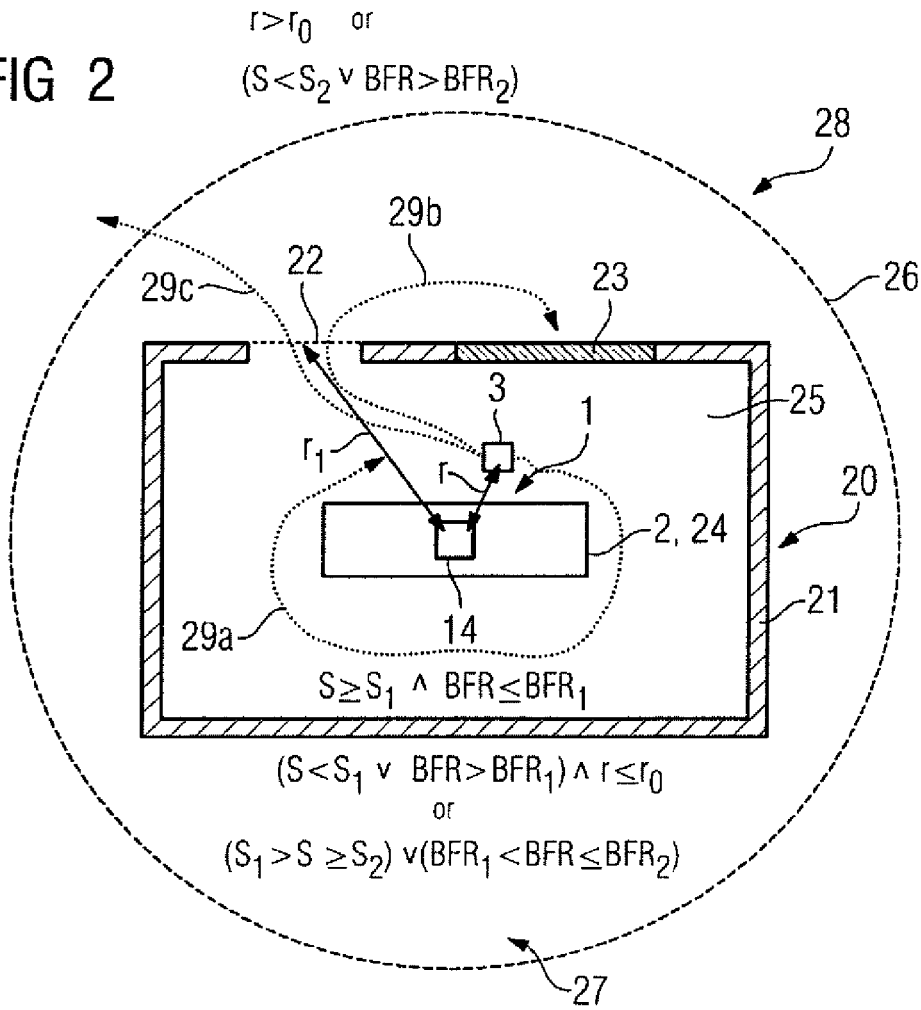
FIG. 2 shows in a roughly schematic top view an examination room with the apparatus according to FIG. 1 arranged therein.

FIG. 2 shows an examination room 20 with a surrounding wall 21, in which a door opening 22 and a radiation-protection window 23 are inset. The medical device 2 and the apparatus (system) 1 provided for operation are disposed in the examination room 20. For reasons of simplification, of the medical device 2, only a patient support 24 is shown in FIG. 2. Of the apparatus 1, the remote control unit 3 and the radio unit 14, which functions as a device-end receiver unit, are shown in FIG. 2.

With regard to the quality of the radio link between the remote control unit 3 and the radio unit 14, three areas are defined. An inner area 25 is enclosed by the wall 21 of the examination room 20. An intermediate area 27 is outside the examination room 20, but inside a predetermined outer limit 26. An outer area 28 is outside the outer limit 26.

The inner area 25 and the intermediate area 27 differ from one another significantly in the transmission quality of the radio link. As along as the remote control unit 3 is disposed in the inner area 25, the variables used as a measure of the transmission quality, signal strength S and bit error rate BFR, will respectively exceed or fall below predetermined threshold values $S_1$ and $BFR_1$. If the remote control unit 3 is taken out of the examination room 20, into the intermediate area 27, then the signal strength S declines, as a consequence of the radio shielding caused by the wall 21, to a value below the threshold value $S_1$, while the bit error rate BFR increases and exceeds the assigned threshold value $BFR_1$. The outer limit 26 separating the intermediate area 27 from the outer area 28 is defined by the distance r of the remote control unit 3 from the radio unit 14. The remote control unit 3 is located in the intermediate area 27 if it is disposed within a critical distance range, namely outside the examination room 20 but inside a threshold distance $r_0$ from the radio unit 14. The remote control 3 is located in the outer area 28 if it is disposed at a distance r from the radio unit 14 that exceeds the threshold distance $r_0$.

The control module 17 may determine the position of the remote control unit 3 by evaluating the signal strength S and the bit error rate BFR.

The control module 17 may compare the signal strength S and the bit error rate BFR with the assigned threshold values $S_1$ and $BFR_1$. Where the signal strength S and the bit error rate BFR exceed or fall below the respective threshold values $S_1$ and $BFR_1$, the control module 17 infers (determines) a position of the remote control unit 3 inside the inner area 25 and consequently enables the keyboard control 9 (by not generating the blocking signal L) without further conditions.

If the control module 17 detects that the signal strength S or the bit error rate BFR fall below or exceed the respectively assigned threshold value $S_1$ or $BFR_1$, then the control module 17 infers (determines) that the remote control unit 3 is outside of the inner area 25 and into the intermediate area 27. The control module 17 determines the distance r and determines by comparing the distance r with the stored threshold distance $r_0$ whether the remote control 3 is located within the intermediate area 27 or within the outer area 28.

If the control module 17 determines that the remote control unit 3 is in the intermediate area 27, then the control module 17 blocks the keyboard control 9 by generating the blocking signal L, but permits manual unblocking of the keyboard control 9 by generating the enabling signal F. The control module 17 may be implemented such that by pressing on the enabling key 7, which generates the enabling signal F, the blocking signal L is cancelled for a predetermined time, for example, 10 seconds. During the predetermined time, operating signals B may be generated effectively and transmitted to the device 2 via the operator keys 6. After expiration of the predetermined time, the control module 17 blocks the keyboard control 9 again, such that the enabling key 7 has to be pressed again to trigger further operating signals B. Alternatively, the predetermined time may be "retriggered" by pressing an operator key 6 within the predetermined time and the keyboard control 9 consequently remains unblocked for a further amount time. The keyboard control 9 is not blocked again until after expiration of the predetermined time following the last effectively triggered operating signal B.

If the control module 17 determines that the remote control unit 3 is in the outer area 28 based on a determination that the trigger criteria ($r>r_0$) is fulfilled, then the control module 17 blocks the keyboard control 9 fully, such that the block cannot be overridden, even by pressing the enabling key 7.

FIG. 2 shows three exemplary movements 29*a*, 29*b* and 29*c* of the remote control unit 3. During the course of the first movement 29*a*, the remote control unit 3 remains inside the inner area 25. During the first movement 29*a*, operating signals B may be triggered unconditionally. During the course of the second and third movements 29*b* and 29*c*, the remote control unit 3 is carried out of the inner area 25 into the intermediate area 27. Unconditional triggering of operating signals B is possible in a first section of the movements 29*b*, 29*c*. For example, as soon as the remote control unit 3 is carried out of the examination room 20, the enabling key 7 has to be pressed before operating signals B are triggered. During the course of the movement 29*c*, the remote control unit 3 is carried over the outer limit 26 and into the outer area 28. During the course of the movement 29*c*, the transmission of operating signals B is blocked as soon as the remote control unit 3 is carried over the outer limit 26.

The control module 17 may indicate to the operator whether the remote control unit 3 is located in the inner area 25, the intermediate area 27 or the outer area 28. The control module 17 may activate the light-emitting diode 8. For example, the light-emitting diode 8 shines green continuously if the remote control unit 3 is located in the inner area 25, flashes green if the remote control 3 is located in the intermediate area, and shines red continuously if the remote control 3 is located in the outer area 28.

The control module 17 may activate the loudspeaker 12, to output an acoustic alarm signal W2 if an operating signal B (in particular, a safety-critical operating signal) is triggered despite a block being in place. A further acoustic alarm signal W2 may be output when the radio link between the remote control unit 3 and the radio unit 14 is interrupted.

To determine the distance r, the control module 17 may use the signal strength S, the bit error rate BFR, and the result of a step detection. Step detection may be carried out by the step detection unit 19, for example, by the acceleration sensor 13 and the step detection module 18.

For step detection, the acceleration sensor 13 records the acceleration acting upon the remote control unit 3 and feeds the acceleration signal A resulting from this measurement to the control module 10. The step detection module 18 may evaluate the temporal course of the acceleration signal A to detect a step movement of a user carrying the remote control unit 3.

Step detection is based on inertia navigation. While walking, the human body performs a periodic upward and downward movement.

At the beginning of a step, the operator raises the respective stepping leg from the ground and moves it past the standing leg. The body of the operator moves upward so that the body experiences a vertical upward acceleration. The body movement reaches its highest point when both legs are located alongside one another. At the highest point, the body experiences no vertical acceleration. As soon as the stepping leg has been led past the standing leg, the body moves downward so that a downward vertical acceleration acts upon the body. The downward vertical acceleration comes to a halt when the stepping leg is placed on the ground again at the conclusion of the step.

The remote control unit 3 has no fixed orientation relative to the surrounding space. From the viewpoint of the remote control unit 3, the vertical direction is not predetermined in a fixed manner. The three-dimensional (3D) acceleration vector is first defined by the acceleration sensor 13 in a stationary system of coordinates in relation to the remote control unit 3. The 3D acceleration vector allows the vertical acceleration associated with a step movement to be recorded. For the evaluation, the step-detection module 18 takes into account only the magnitude of this acceleration vector in the form of the acceleration signal A (Equation 1).

$$A=\mathrm{sqrt}(a_x^2+a_y^2+a_z^2), \qquad \text{Equation 1}$$

where $a_x^2$, $a_y^2$ and $a_z^2$ are components of the three-dimensional acceleration vector.

The acceleration vector, which is recorded by the acceleration sensor 13, is generally oriented in a vertical spatial direction due to the dominant influence of acceleration due to gravity. The magnitude of the acceleration vector is influenced (e.g., almost exclusively only) by vertical acceleration changes, while the influence of horizontal accelerations on the magnitude of the acceleration vector remains negligible.

An acceleration value below the value of acceleration due to gravity (1 g) is an indication of a vertically downwardly directed acceleration of the remote control unit 3, while an acceleration magnitude that exceeds the value of acceleration due to gravity is an indication of an upwardly directed vertical acceleration of the remote control unit 3.

Figure 3:
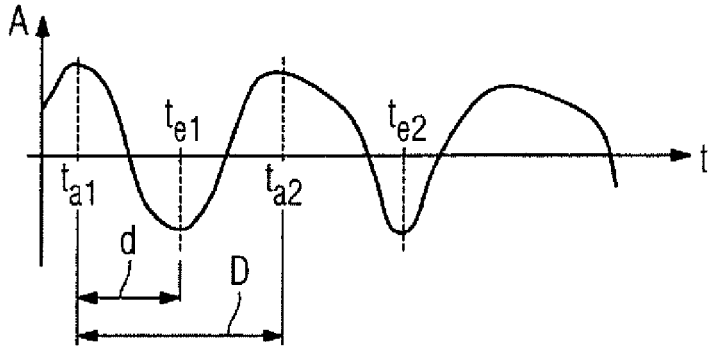
FIG. 3 shows in a schematic diagram the temporal course of the acceleration acting upon the remote control unit as an operator holding the remote control makes a step movement.

A step movement consequently results in a temporal course of the acceleration signal A that oscillates about the magnitude of the acceleration due to gravity. To prevent triggering errors caused by vibrations or other body movements, the acceleration signal A may be smoothed by the step-detection module 18. The step-detection module 18 may apply an exponential moving average (EMA) filter to smooth the acceleration signal A. FIG. 3 shows an example of a temporal course of the correspondingly smoothed acceleration signal A during a step movement.

As shown in FIG. 3, a high point of the acceleration signal A (i.e. a local maximum of the acceleration value) indicates the start of a step, while a low point (i.e. a local minimum) of the acceleration signal A indicates the termination of a step. The start times $t_{a1}$, $t_{a2}$ and end times $t_{e1}$, $t_{e2}$ of two consecutive steps are plotted in FIG. 3.

Figure 4:
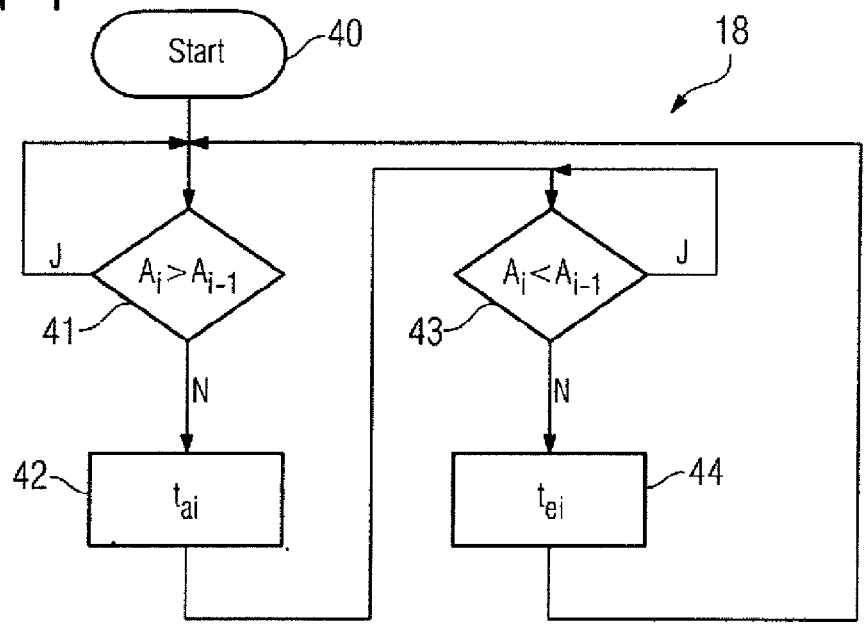
FIG. 4 shows in a flow diagram a method for detecting a step movement by evaluating the recorded acceleration.

To detect a step movement, the step-detection module 18 searches, in accordance with a method outlined in a simplified manner in FIG. 4, for high points and low points of the smoothed acceleration signal A. After the program start (act 40), the current value $A_i$ of the acceleration signal A is recorded cyclically and compared with the respectively preceding value $A_{i-1}$ (act 41). Once the current value $A_i$ exceeds the respectively preceding value $A_{i-1}$ (J), act 41 is repeated, with the current value $A_i$ being read in afresh in each case and the previously current value being stored as the new preceding value $A_{i-1}$. Once the current value $A_i$ falls below the preceding value $A_{i-1}$ (N), this is deemed to be an indication that a high point has occurred. In this case, in act 42, the time corresponding to the current value $A_i$ is stored as the start time $t_{ai}$ of a step.

In act 43, the current value $A_i$ is then again read and compared with the preceding value $A_{i-1}$. If it is established that the current value $A_i$ falls below the preceding value $A_{i-1}$ (J), then act 43 is repeated. Otherwise (N), the time corresponding to the current value $A_i$ is stored as the end time $t_{ei}$ of the step. The step-detection module 18 feeds the stored start times $t_{ai}$ and end times $t_{ei}$ to the control module 17 as a pointer to a detected step movement.

The control module 17 may calculate, based on the recorded signal strength S, the bit error rate BFR, and the information about the step movement, the current distance r of the remote control unit 3 from the radio unit 14.

Figure 5:
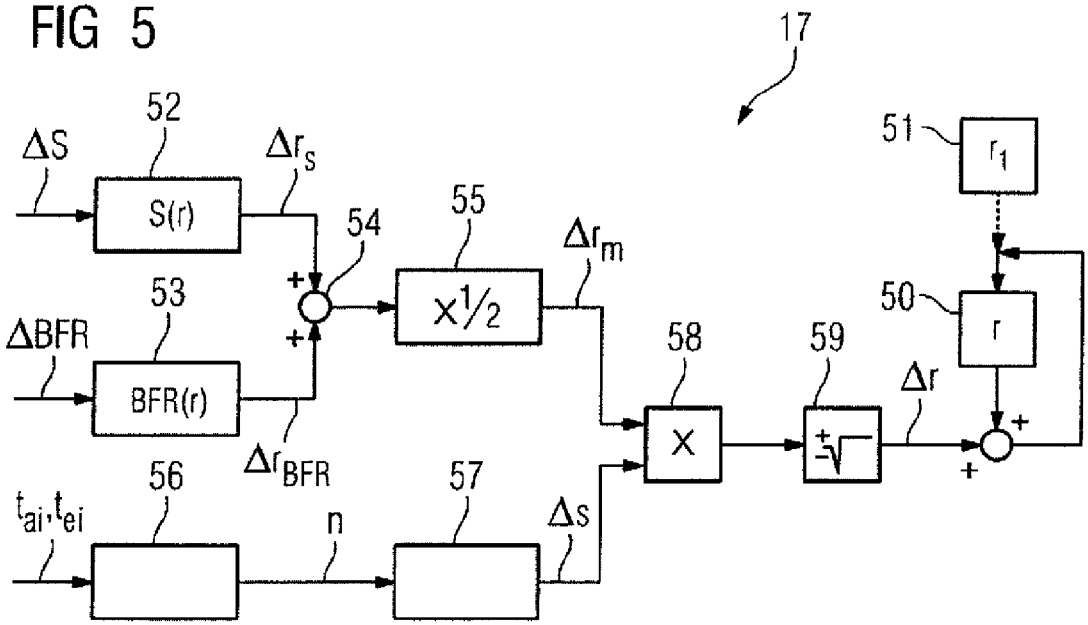
FIG. 5 shows in a block diagram a method for determining the distance of the remote control unit from the device.

FIG. 5 illustrates a sample embodiment of a method for calculating the distance r. The control module 17 may initialize a distance variable r (block 50) with an initial value $r_1$ (block 51) if it establishes on the basis of the signal strength S or the bit error rate BFR that the remote control unit 3 is outside of the inner area 25. The initial value $r_1$ corresponds to the distance between the radio unit 14 and the door opening 22 (see FIG. 2).

The control module 17 may determine, at predetermined time intervals, the changes ΔS, ΔBFR in the signal strength S, and the bit error rate BFR, respectively. From the change ΔS, the control module 17 derives, for example, on the basis of a stored characteristic curve S(r) (block 52), a distance change $\Delta r_S$. Using a stored characteristic curve BFR(r) (block 53), the control module 17 may derive, for example, from the change ΔBFR, a distance change $\Delta r_{BFR}$. By averaging (blocks 54 and 55), the control module 17 derives, for example, from the distance changes $\Delta r_S$ and $\Delta r_{BFR}$, an average distance change $\Delta r_m$. The average distance change $\Delta r_m$ may correspond to the distance change that emerges from the evaluation of the transmission quality.

The control module 17 may use the result of the step detection provided by the step-detection module 18, for example, the start times $t_{ai}$ and end times $t_{ei}$ of the detected step movement recorded within the observed time interval. The control module 17 may calculate in block 56 the number of steps detected in the time interval (referred to hereinbelow as the number of steps n). By multiplying the number of steps n with a stored average step length, the control module 17 determines (block 57) a path covered by the step movement Δs.

The average distance change $\Delta r_m$ and the path Δs may be correlated with one another by geometric averaging (blocks 58 and 59). In block 59, a sign-retaining root formation is performed. The mathematical operation performed by the blocks 58 and 59 corresponds to the formula: $\mathrm{sign}(\Delta r_m \cdot \Delta s) \cdot \mathrm{sqrt}(\Delta r_m \cdot \Delta s)$.

The result of the geometric averaging is the distance change Δr to be calculated in accordance with the method. Based on the distance change Δr, the distance variable r is updated in accordance with the formula $r=r+\Delta r$.

Using the method shown in FIG. 5, the transmission quality is a result correlated with the outcome of the step detection to the extent that a change in the transmission quality is taken into account in relation to a change in the distance variable r only if at the same time a step movement has been identified. The distance variable r is not affected by a change in the transmission quality that is not associated with a step movement. A detected step movement, which is not correlated with a change in transmission quality, does not lead to a change in the distance variable r.

Figure 6:
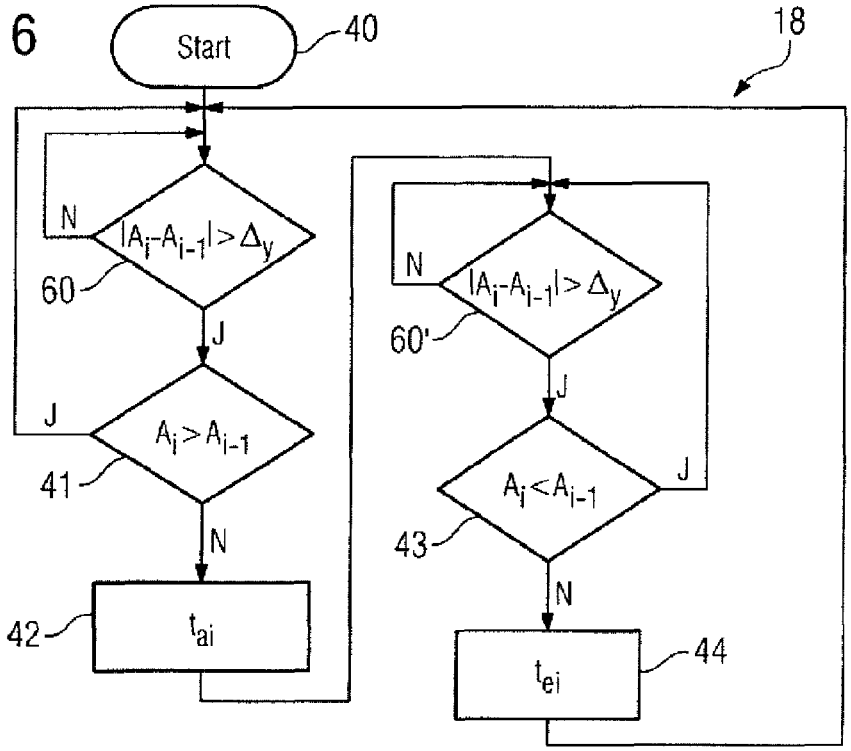
FIG. 6 shows in a representation according to FIG. 4 an alternative embodiment of the method therein and FIG. 7 shows in a representation according to FIG. 4 a further embodiment of the method therein.

FIG. 6 shows another embodiment for searching for high points and low points of the smoothed acceleration signal A. An act 60 or 60' is added ahead of acts 41 and 43 respectively. A check is carried out as to whether the smoothed acceleration A undergoes a sufficiently large change (act 60 or 60'), for example, a change that exceeds a threshold value Δy, before reaching a high or low point. If this is the case (J), then in the subsequent act 41 or 43, a check is carried out as to whether a high or a low point is present. Otherwise (N), act 60 or 60' is repeated. By adding the act 60, 60' in advance, the risk of an error in detecting a high or low point, for example, as a result of noise effects or short-term vibrations, is significantly reduced.

Figure 7:
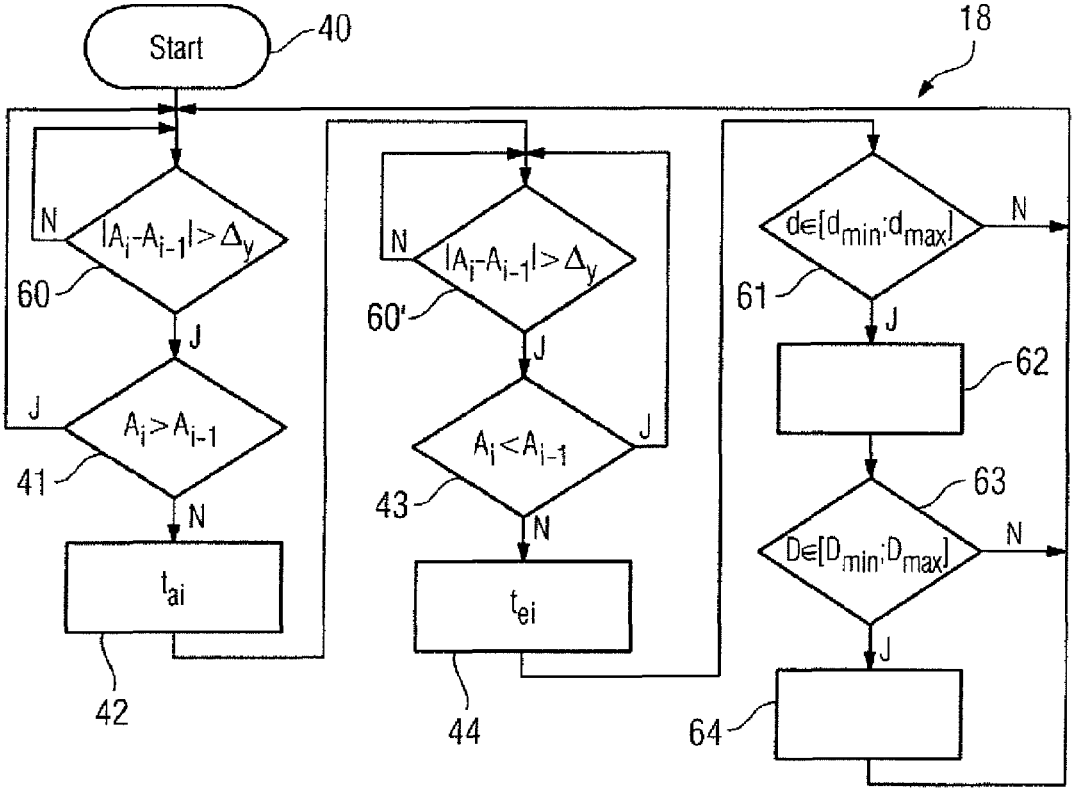

FIG. 7 illustrates an exemplary extension of the method according to FIG. 6. After the detection of a high point or low point, a step duration d and, as a measure of the step frequency of consecutive steps, a step sequence duration D are determined on the basis of the stored start time $t_{ai}$ and end time $t_{ei}$ of a detected step. The step duration d is defined by the time interval between the detected high point $t_{ai}$ and the subsequent low point $t_{ei}$. The step sequence duration D is determined by the time interval between two consecutive start times $t_{ai-1}$ and $t_{ai}$ (see FIG. 3).

In the method according to FIG. 7, the step-detection module 18 checks whether the step duration d lies within an expected interval [$d_{min}$; $d_{max}$] which is predetermined by stored threshold values $d_{min}$ and $d_{max}$ (act 61). If this is the case (J), then the step-detection module 60 flags (act 62) that a valid step has been detected. Otherwise (N), the method flow goes back to act 60.

If a valid step has been detected, then the step-detection module 18 checks in act 63 whether the step sequence duration D lies within an expected range [$D_{min}$; $D_{max}$] with threshold values $D_{min}$ and $D_{max}$. If this is the case (J), then the step-detection module 18 flags that a valid subsequent step of a step sequence has been detected (act 64) and goes back to act 60. The program flow otherwise goes back directly from act 63 to act 60.

The step-detection module 18 determines from the results of act 62 and 64 how many valid acts have been detected consecutively in a valid sequence and derives from the result, on the basis of a stored characteristic curve, a plausibility value for the detected step movement. The derivation of the plausibility value is based on the recognition that a detected step movement, which consists solely of a single step in isolation, is marked by a comparatively high degree of uncertainty. Vibrations of the remote control unit 3 may, with a comparatively high degree of probability, also give rise to an acceleration pattern that is detected according to the method as a single step. The probability of such a detection error occurring decreases with increasing regularity of the acceleration signal A, as produced by a longer step sequence. The plausibility value is made available by the step-detection module 18 to the control module 17 and is utilized by the control module 17.

The control module 17 may calculate, on the basis of the plausibility value, an error value for the distance variable r. The error value may be taken into account when deciding whether the transmission of operating signals should be permitted or blocked. For example, the control module 17 may prompt an operator via the light-emitting diode 8 and/or the loudspeaker 12 through suitable alarm signals W1,W2 to bring the remote control 3 back into the inner area 25 if the error value exceeds a predetermined maximum value.

The distance between the remote control unit 3 and the radio unit 14 may be estimated exclusively based on the transmission quality, for example, on the basis of the signal strength S and the bit error rate BFR. No distance measurement is explicitly calculated in this variant of the method.

The control module 17 may check first in accordance with FIG. 2 by comparing the signal strength S and the bit error rate BFR with the assigned threshold values $S_1$ and $BFR_1$ whether the remote control unit 3 is located in the inner area 25 and in this case enables the keyboard control 9 without further conditions.

If the control module 17 detects, for example, in accordance with FIG. 2, that the remote control unit 3 is outside of the inner area 25 and in the intermediate area 27, then the control module 17, deviating from the method variant described above, checks at predetermined time intervals whether the signal strength S or the bit error rate BFR falls below or exceeds a respectively assigned second threshold value $S_2$ or $BFR_2$. With respect to the second threshold values, the relations $S_2<S_1$ and $BFR_2>BFR_1$ apply, where the threshold values $S_2$ and $BFR_2$ respectively correspond approximately to the value of the signal strength S or bit error rate BFR that is to be expected on average when the remote control unit 3 is located at a distance $r=r_0$ from the radio unit 14. If the trigger criteria $(S<S_2)\vee(BFR>BFR_2)$ is fulfilled, then the control unit 17 pinpoints the remote control unit 3 in the outer area 28, if simultaneously, for example, in the preceding time interval, a step movement has been detected by the step detection unit 19 in the manner described above, and in this case blocks the emission of operating signals.

Otherwise, in the absence of a detected step movement, the control unit 17 pinpoints the remote control unit 3 in the intermediate area 27 and enables the emission of operating signals B in enabled mode, even if the signal quality would fulfill the trigger criteria stated above.

In order to achieve a sufficiently good temporal resolution, but be able to detect a step movement reliably, the above-mentioned time interval is preferably of the order of a few seconds, for example, between about 15 and 30 seconds.

In one embodiment, the control unit 17 checks continuously over time the trigger criteria $(S<S_2)\vee(BFR>BFR_2)$, and if this criteria is fulfilled, blocks the emission of operating signals if a step movement has been detected in a moving amount of time prior to fulfillment of the trigger criteria. The amount of time is preferably several seconds, for example, between 15 and 30 seconds.

The control unit 17 takes into account, when deciding about the blocking or enabling of operating signal transmission, the plausibility of the detected step movement. Operating signal transmission may be blocked only when at least one predetermined number of steps has been detected in sequence within the time interval or time window.

The invention claimed is:

1. A method for cableless transmission of operating signals from a mobile remote control unit to a device, the method comprising:

recording a transmission quality measurement, and blocking the transmission of the operating signals when the transmission quality measurement fulfils a predetermined trigger criteria, detecting, by the remote control unit, a step movement of a user of the remote mobile control unit, wherein a change in the transmission quality measurement is taken into account with respect to a change in a distance between the mobile remote control unit and the device when the step movement is detected.

2. The method as claimed in claim 1, wherein detecting the step movement comprises: recording and evaluating an acceleration acting upon the remote control unit.

3. The method as claimed in claim 2, comprising: recording at least one high point and at least one low point of the acceleration.

4. The method as claimed in claim 3, comprising: comparing a change in acceleration to a stored threshold value, before a high point of the at least one high point or a low point of the at least one low point is reached.

5. The method as claimed in claim 3, comprising: determining a characteristic variable for a step duration or a step frequency.

6. The method as claimed in claim 5, comprising: determining a plausibility value that represents a measure of an error probability of the detected step movement based upon the characteristic variable.

7. The method as claimed in claim 1, wherein the transmission of the operating signals is enabled irrespective of the change in the transmission quality measure and irrespective of the step movement detection when the transmission quality measurement, a distance measurement, or the transmission quality measurement and the distance measurement exceed a predetermined threshold value.

8. The method as claimed in claim 1, wherein the triggering of an operating signal is permitted only in combination with the triggering of an enabling signal when the transmission quality measurement, a distance measurement, or the transmission quality measurement and the distance measurement lie in a predetermined critical range.

9. The method as claimed in claim 1, comprising: outputting an optical or acoustic alarm signal when there is an attempt to trigger a blocked operating signal.

10. The method as claimed in claim 1, wherein the detected step movement is a vertical step movement due to the user walking.

11. The method as claimed in claim 1, wherein blocking the transmission of the operating signals comprises blocking the transmission of the operating signals when a distance measurement between the mobile remote control unit and a receiver unit of the device fulfills another predetermined trigger criteria.

12. A system for cableless operation of a device, the system comprising:

a mobile remote control unit for the cableless transmission of operating signals to the device, the mobile remote control unit having a step movement detection unit configured to detect a step movement of a user of the mobile remote control unit; and a receiver unit assigned to the device and a control module, wherein the control module is configured to record a transmission quality measurement and configured to block the transmission of the operating signals when the transmission quality measurement fulfils a predetermined trigger criteria, and wherein the control module is configured to take a change in the transmission quality measurement into account with respect to a change in a distance between the mobile remote control unit and the device when the step movement is simultaneously detected by the step movement detection unit.

13. The system as claimed in claim 12, wherein the step movement detection unit includes an acceleration sensor for recording an acceleration acting upon the mobile remote control unit, and an evaluation module for detecting the step movement on the basis of the recorded acceleration.

14. The system as claimed in claim 13, wherein the evaluation module is operable to detect the step movement by recording at least one high point and at least one low point of an acceleration.

15. The system as claimed in claim 14, wherein the evaluation module is operable to detect the step movement by recording a change in the acceleration in comparison to a stored threshold value before a high point of the at least one high point or a low point of the at least one low point is reached.

16. The system as claimed in claim 14, wherein, to detect the step movement, the evaluation module is operable to determine a characteristic variable for a step duration or a step frequency.

17. The system as claimed in claim 16, wherein the evaluation module is operable to derive from the characteristic variable a plausibility value that represents a measure of an error probability of the detected step movement.

18. The system as claimed in claim 12, wherein the evaluation module is operable to enable the transmission of the operating signals irrespective of the change in the transmission quality measurement and irrespective of the step detection when the transmission quality measurement, a distance measurement, or the transmission quality measurement and the distance measurement exceed a predetermined threshold value.

19. The system as claimed in claim 12, wherein the triggering of an operating signal is permitted only in combination with the triggering of an enabling signal when a transmission quality, a distance measurement, or the transmission quality and the distance measurement are within a predetermined critical range.

20. The system as claimed in claim 12, wherein the mobile remote control unit is operable to output an optical or acoustic alarm signal in the event of an attempt being made to trigger a blocked operating signal.

21. The system as claimed in claim 12, wherein the device is a medical device.

22. The system of claim 12, wherein the control module is configured to block the transmission of the operating signals when a distance measurement between the mobile remote control unit and the receiver unit of the device fulfills another predetermined trigger criteria.

* * * * *